US011586122B1

(12) United States Patent
Naitou

(10) Patent No.: US 11,586,122 B1
(45) Date of Patent: Feb. 21, 2023

(54) IMAGE FORMING APPARATUS PROVIDED WITH ABUTTING AND SUPPORT STRUCTURES

(71) Applicant: TOSHIBA TEC KABUSHIKI KAISHA, Tokyo (JP)

(72) Inventor: Tomoki Naitou, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/466,571

(22) Filed: Sep. 3, 2021

(51) Int. Cl.
*G03G 15/04* (2006.01)
*G03G 21/00* (2006.01)
*G03G 21/16* (2006.01)

(52) U.S. Cl.
CPC ... *G03G 15/04036* (2013.01); *G03G 21/0011* (2013.01); *G03G 21/1619* (2013.01)

(58) Field of Classification Search
CPC ..... G03G 15/04036; G03G 21/0011; G03G 21/1619
See application file for complete search history.

(56) References Cited

U.S. PATENT DOCUMENTS

2011/0299883 A1* 12/2011 Suzuki ..... G03G 15/04036 399/110
2014/0232803 A1 8/2014 Kobayashi
2018/0275556 A1* 9/2018 Nagamine ..... G03G 15/04036
2020/0272090 A1* 8/2020 Moroka ..... G03G 15/04036

FOREIGN PATENT DOCUMENTS

JP 2006-084637 A 3/2006
JP 2014-021156 A 2/2014
JP 2014-024241 A 2/2014

* cited by examiner

*Primary Examiner* — Sandra Brase
(74) *Attorney, Agent, or Firm* — Foley & Lardner LLP

(57) ABSTRACT

An image forming apparatus includes a photoconductor, a bearing body, an abutting portion, a support frame, an exposure device, and an urging body. The photoconductor includes a shaft portion at an end portion. The bearing body is configured to receive the shaft portion. The abutting portion is coupled to the bearing body. The support frame is configured to support the abutting portion and the bearing body. The exposure device faces the photoconductor, abuts on the abutting portion, and includes a light source exposing the photoconductor to light. The urging body is configured to press the exposure device toward the support frame, urge the abutting portion toward the bearing body and the shaft portion, and urge the bearing body toward the support frame.

15 Claims, 11 Drawing Sheets

IMAGE FORMING APPARATUS PROVIDED WITH ABUTTING AND SUPPORT STRUCTURES

FIELD

Embodiments described herein relate generally to an image forming apparatus.

BACKGROUND

An image forming apparatus maintains a state where a photoconductor drum and a print head are separated by a predetermined distance. The image forming apparatus exposes the photoconductor drum with the print head to form a latent image on the photoconductor drum.

DETAILED DESCRIPTION

In general, according to at least one embodiment, an image forming apparatus includes a photoconductor, a bearing body, an abutting portion, a support frame, an exposure device, and an urging body. The photoconductor has a shaft portion at an end portion of the photoconductor. The bearing body receives the shaft portion. The abutting portion is provided in the bearing body. The support frame supports the abutting portion and the bearing body. The exposure device has a light source that faces the photoconductor and exposes the photoconductor with light and abuts on the abutting portion. The urging body presses the exposure device toward the support frame, urges the abutting portion toward the bearing body and the shaft portion, and urges the bearing body toward the support frame.

First Embodiment

An image forming apparatus 10 according to at least a first embodiment will be described with reference to FIGS. 1 to 14.

Figure 1:
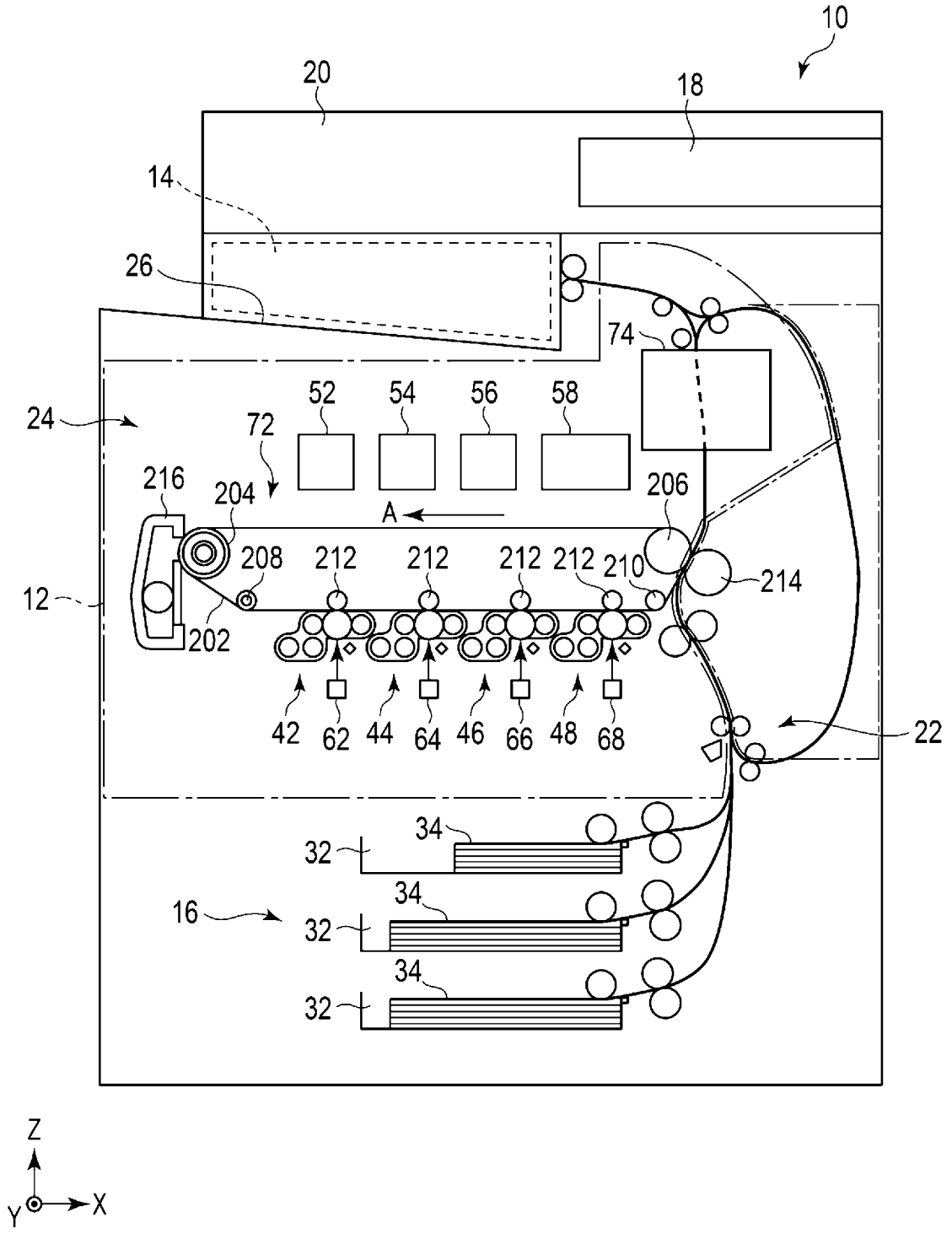
FIG. 1 is a schematic view of an image forming apparatus according to a first embodiment and a second embodiment.

FIG. 1 illustrates the image forming apparatus 10. The image forming apparatus 10 takes an X-axis in which a direction from a left side to a right side when viewed from a front side of the image forming apparatus 10 is set as the + direction thereof, takes a Y-axis in which a direction from a back side to the front side is set as the + direction thereof, and takes a Z-axis in which a direction from a bottom to a top is set as the + direction thereof. It is noted that the direction along the X-axis is along the left-right direction when viewed from the front side of the image forming apparatus 10. The direction along the Y-axis is along the front-back direction when viewed from the front side of the image forming apparatus 10. The direction along the Z-axis is along the up-down direction when viewed from the front side of the image forming apparatus 10.

Figure 2:
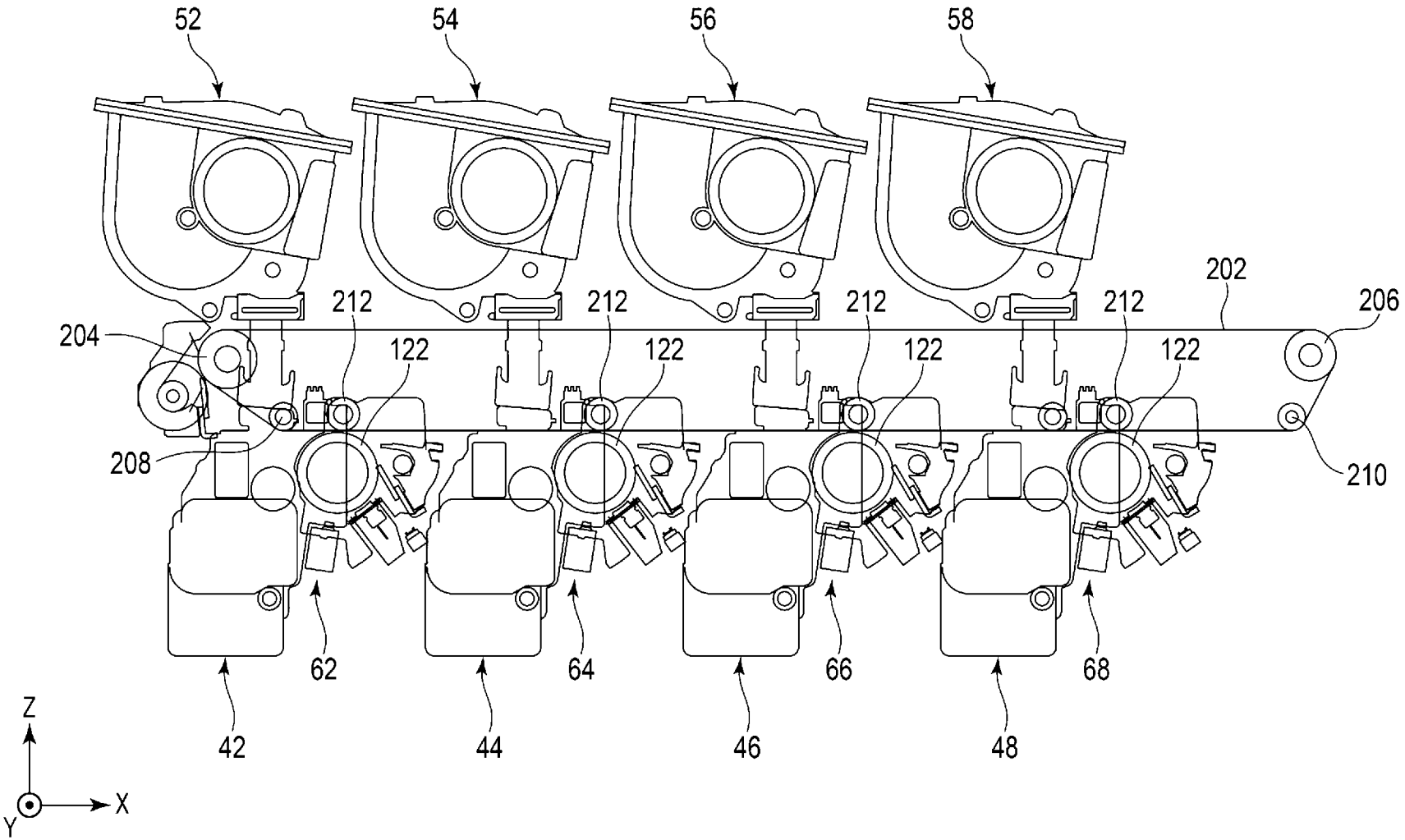
FIG. 2 is a view of a portion of a printer viewed from a front side of the image forming apparatus.
Figure 3:
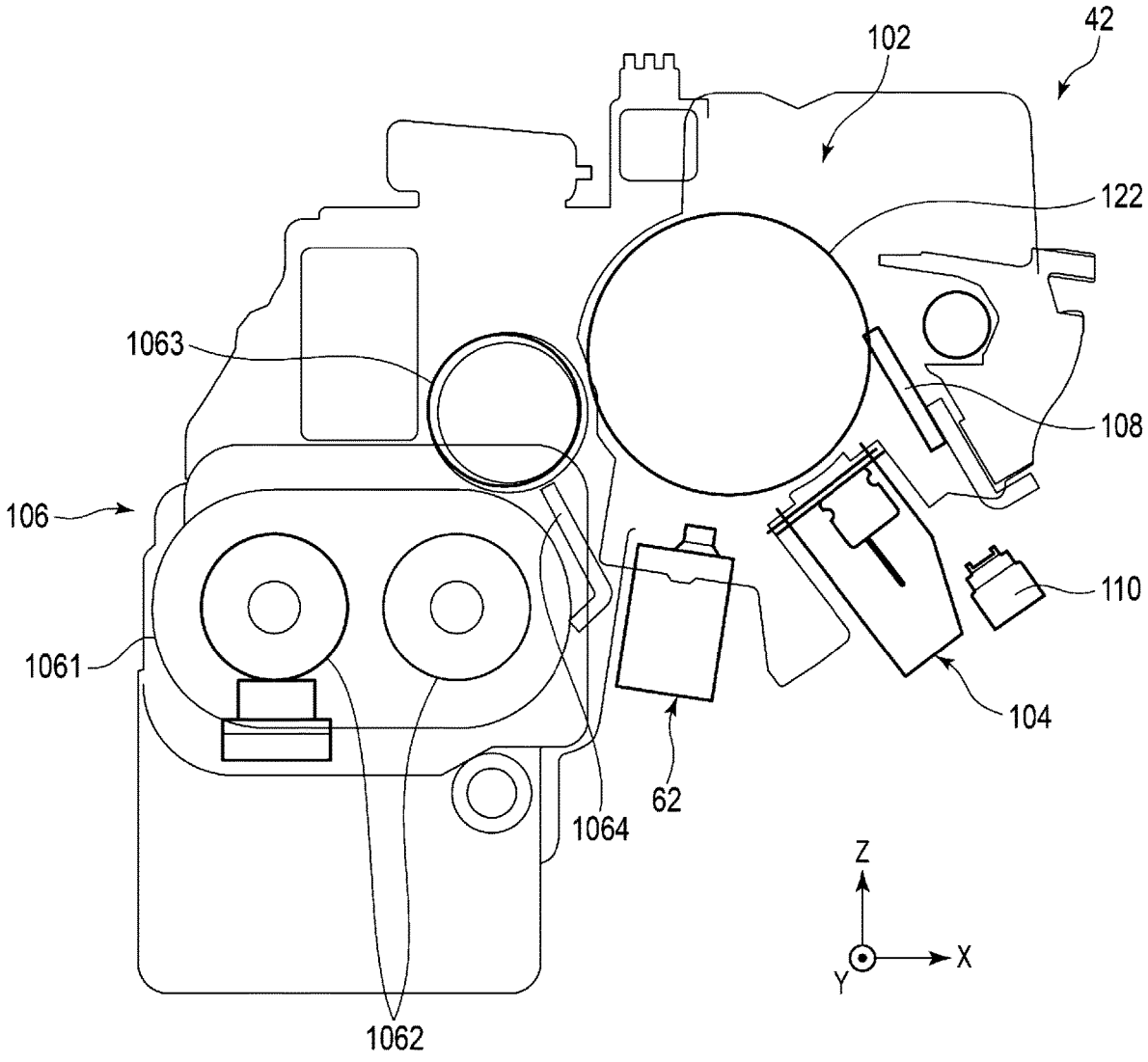
FIG. 3 is a view of an image forming unit and a solid-state head unit of the printer viewed from the front side of the image forming.

FIG. 2 is a diagram of image forming units 42, 44, 46, and 48 (e.g., image forming devices), toner cartridges 52, 54, 56, and 58, solid-state head units 62, 64, 66, and 68 (e.g., solid-state head devices), and a transfer unit 72 (e.g., a transfer device) of a printer 24 as viewed from the front side of the image forming apparatus 10. FIG. 3 is a view of the image forming unit 42 and the solid-state head unit 62 of the printer 24 as viewed from the front side of the image forming apparatus 10.

Figure 4:
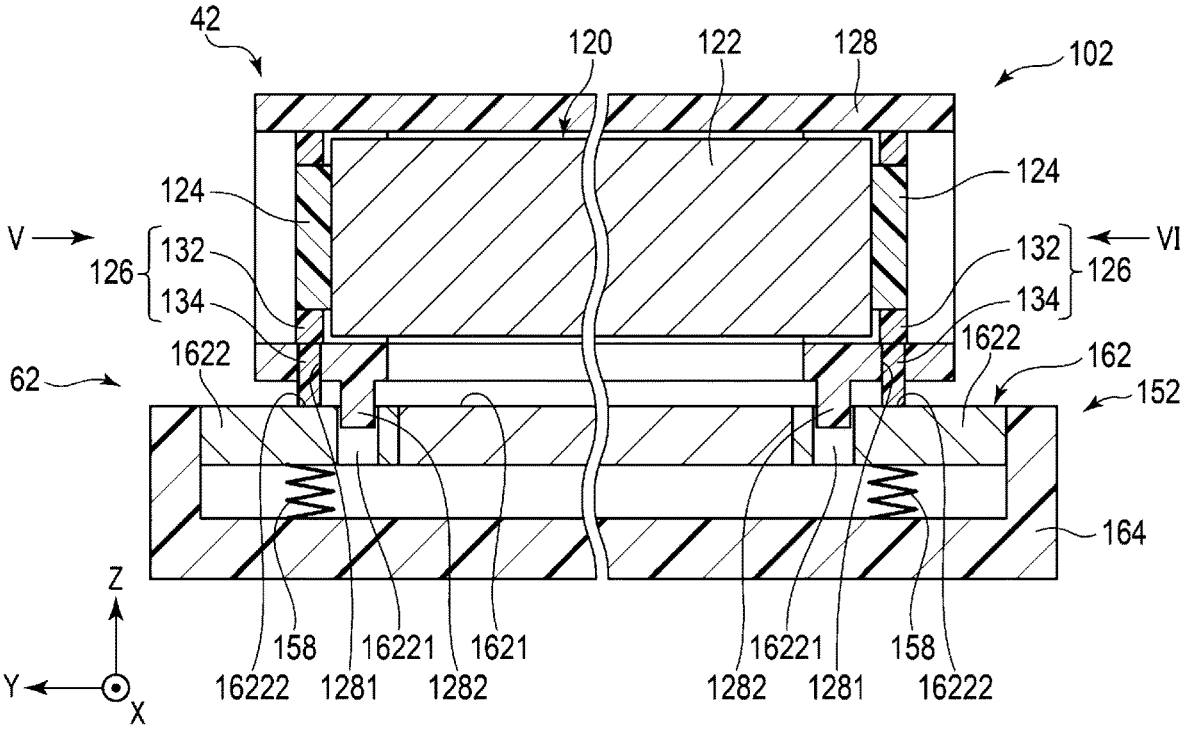
FIG. 4 is a schematic cross-sectional view of an image forming unit and a solid-state head unit of a printer viewed from a right side of the image forming apparatus.
Figure 5:
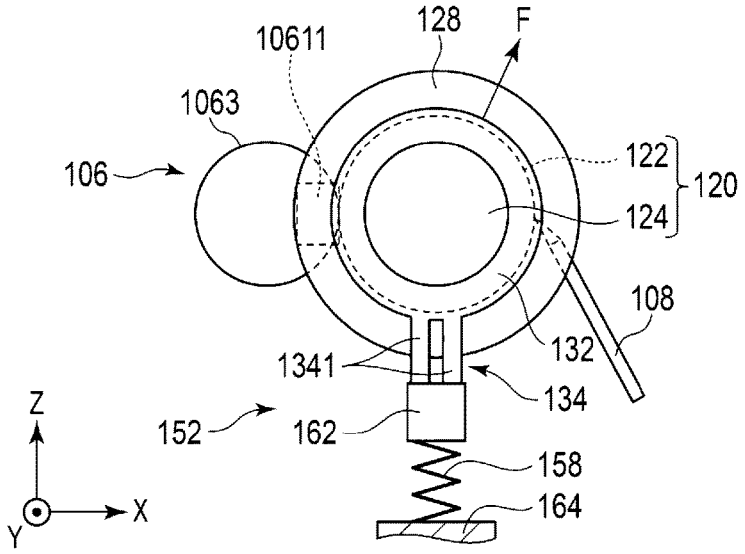
FIG. 5 is a schematic partial cross-sectional view of the image forming unit and the solid-state head unit of the printer viewed from a direction indicated by an arrow V in FIG. 4.
Figure 6:
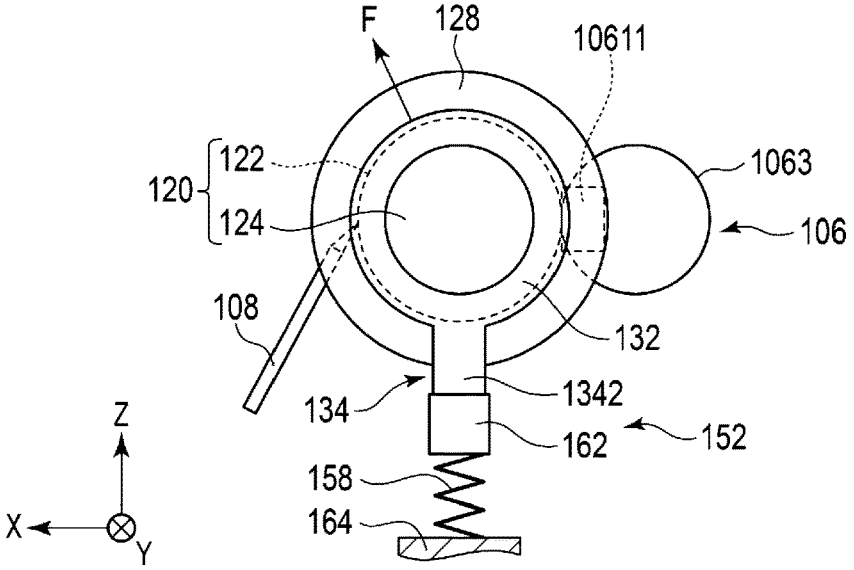
FIG. 6 is a schematic partial cross-sectional view of the image forming unit and the solid-state head unit of the printer viewed from a direction indicated by an arrow VI in FIG. 4.
Figure 7:
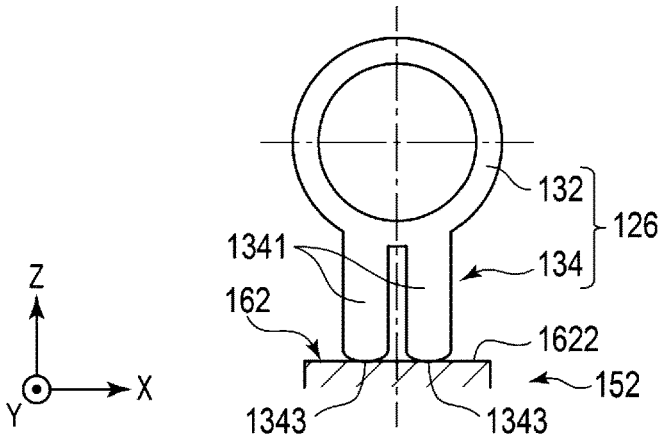
FIG. 7 is a schematic view illustrating a portion of a bearing of the photoconductor unit and a portion of a print head of the solid-state head unit illustrated in FIG. 5.
Figure 8:
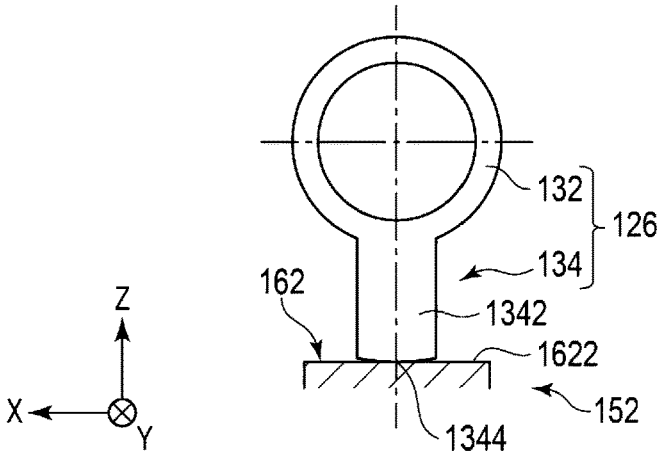
FIG. 8 is a schematic view illustrating a portion of a bearing of a photoconductor unit and a portion of a print head of a solid-state head unit illustrated in FIG. 6.

FIG. 4 is a schematic cross-sectional view illustrating a photoconductor unit 102 (e.g., a photoconductor) of the image forming unit 42 and an exposure device 152 of the solid-state head unit 62 of the printer 24 as viewed from the right side of the image forming apparatus 10. FIG. 5 is a schematic partial cross-sectional view illustrating the photoconductor unit 102 of the image forming unit 42 and the exposure device 152 of the solid-state head unit 62 of the printer 24 as viewed from the front side of the image forming apparatus 10 (the direction indicated by an arrow V in FIG. 4). FIG. 6 is a schematic partial cross-sectional view illustrating the photoconductor unit 102 of the image forming unit 42 and the exposure device 152 of the solid-state head unit 62 of the printer 24 as viewed from the back side of the image forming apparatus 10 (the direction indicated by an arrow VI in FIG. 4). FIG. 7 is a schematic view illustrating a portion of a bearing 126 of the photoconductor unit 102 and a portion of a print head 162 of the solid-state head unit 62 illustrated in FIG. 5. FIG. 8 is a schematic view illustrating a portion of the bearing 126 of the photoconductor unit 102 and a portion of the print head 162 of the solid-state head unit 62 illustrated in FIG. 6.

Figure 9:
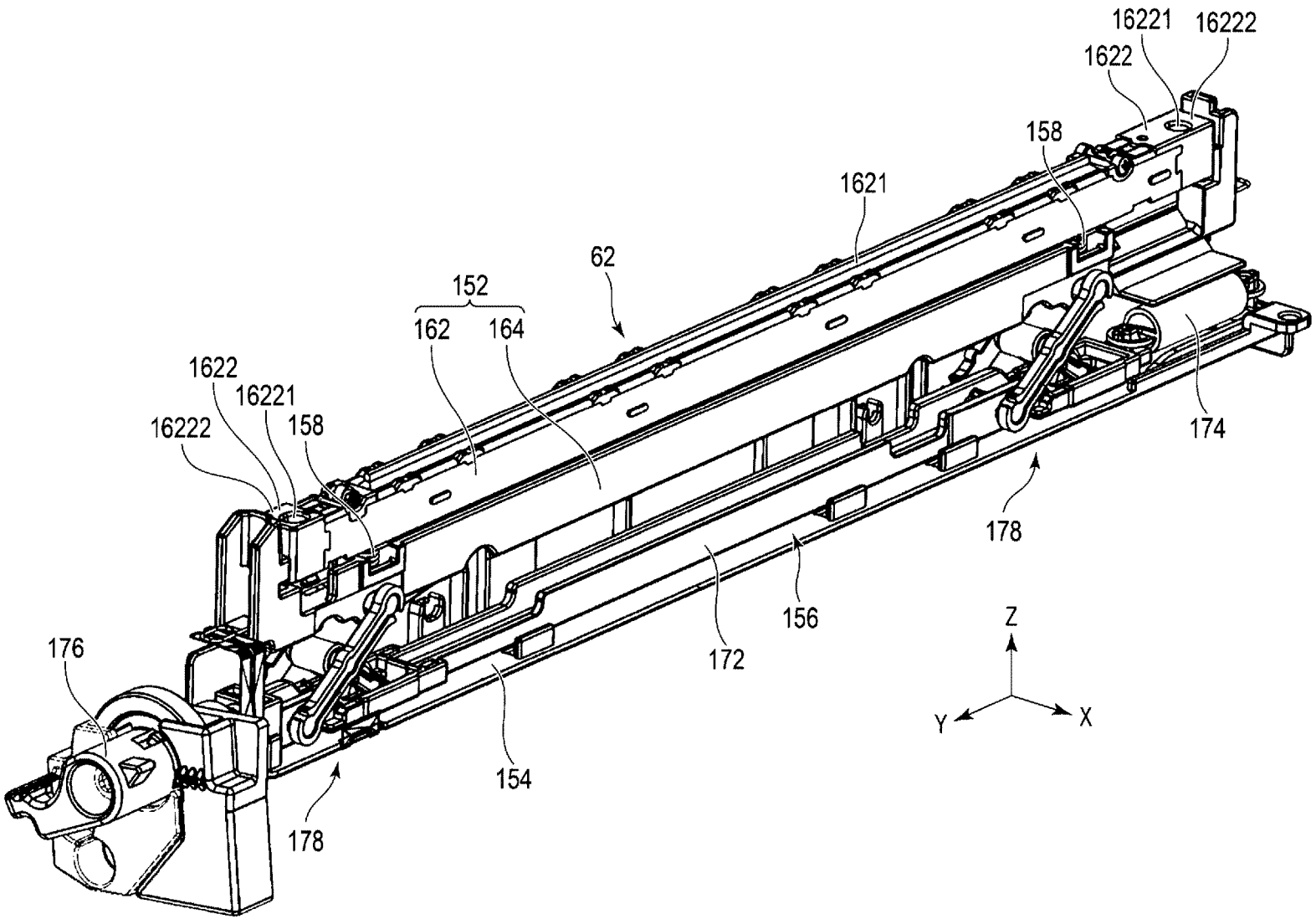
FIG. 9 is a schematic perspective view illustrating the solid-state head unit.
Figure 10:
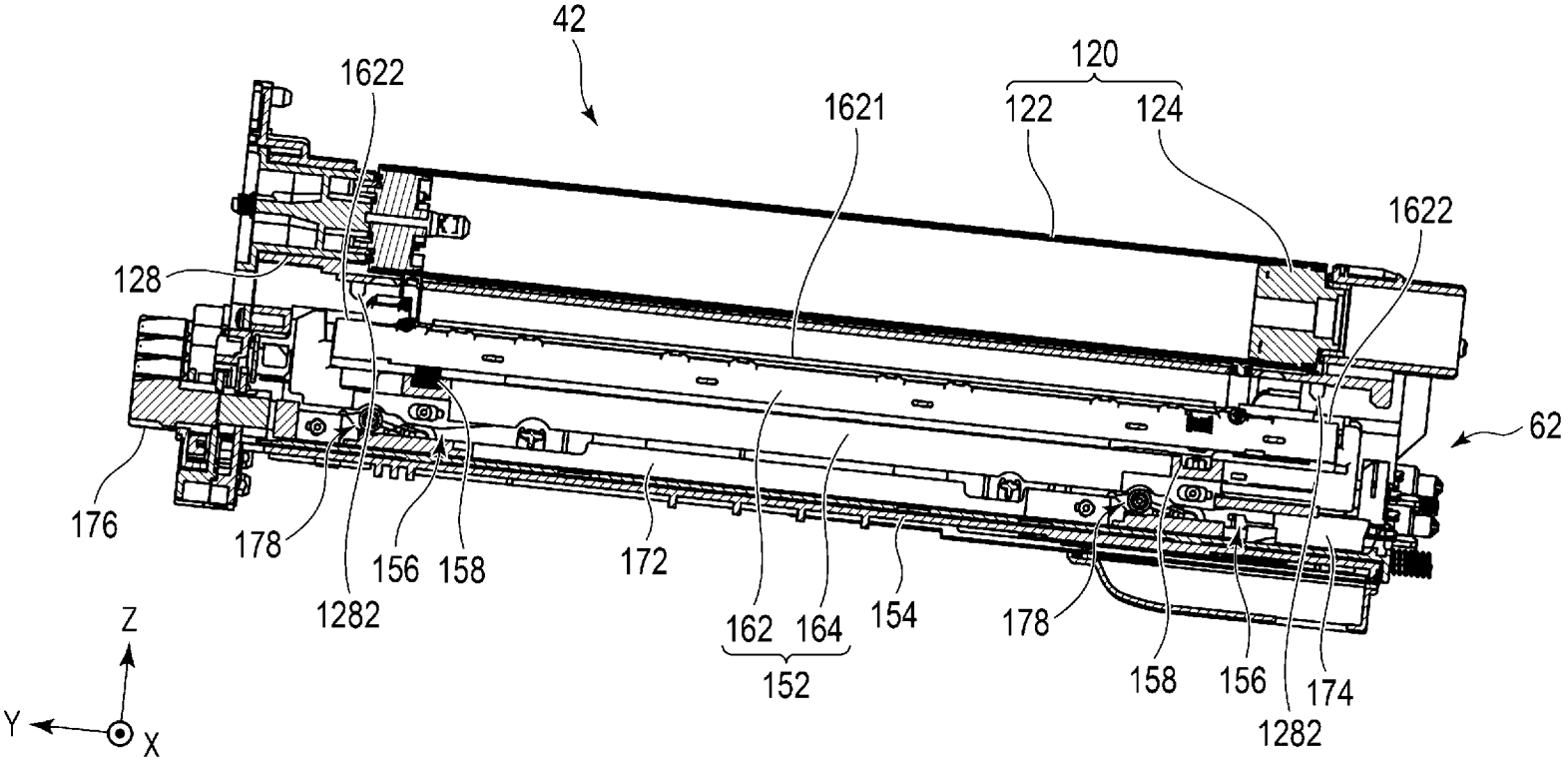
FIG. 10 is a schematic partial cross-sectional view along a longitudinal direction of an exposure device and a photoconductor unit of the solid-state head unit.
Figure 11:
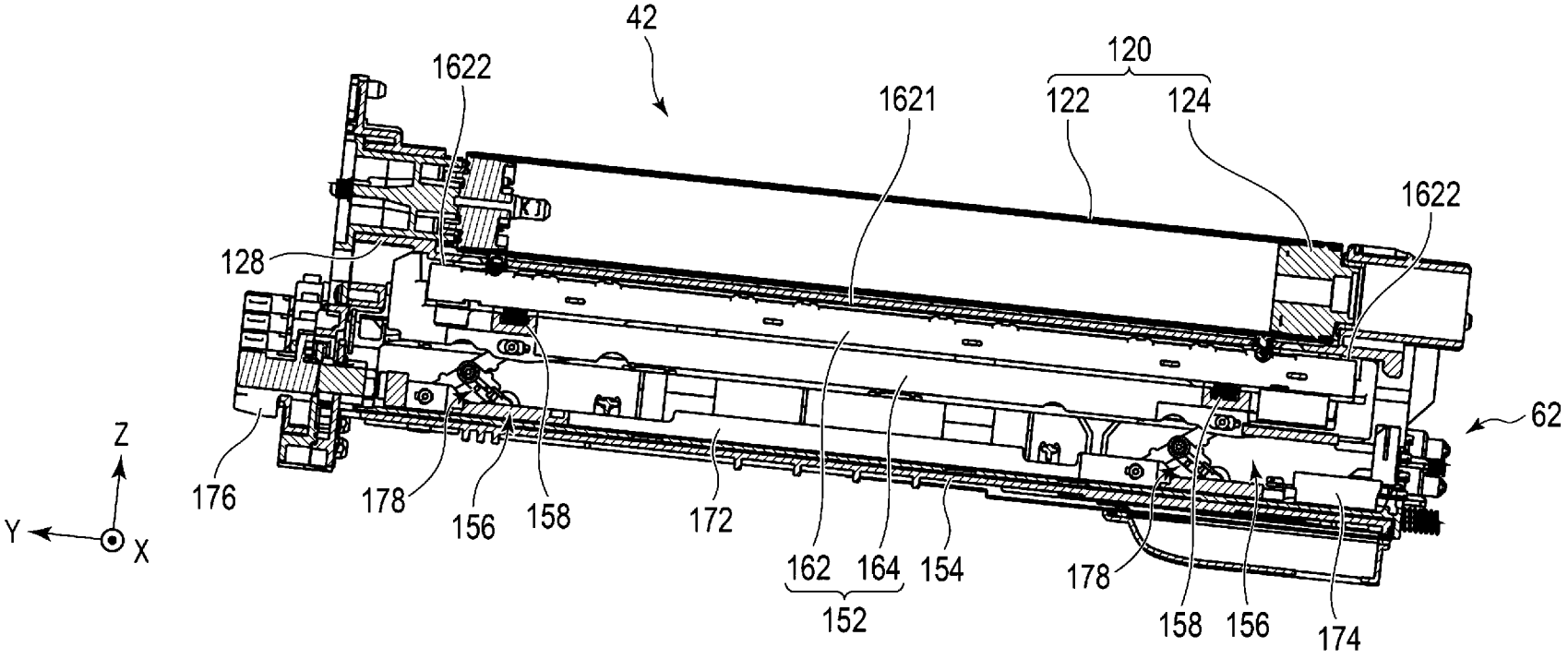
FIG. 11 is a schematic partial cross-sectional view along a longitudinal direction of an exposure device and a photoconductor unit of the solid-state head unit.
Figure 12:
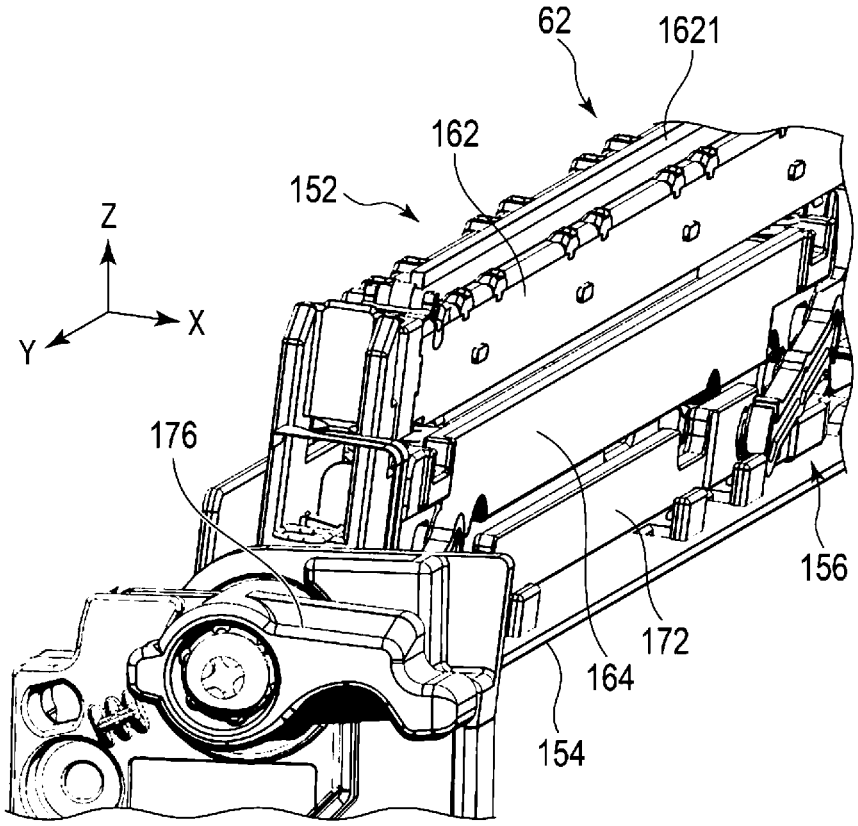
FIG. 12 is a schematic perspective view illustrating a portion of the solid-state head.
Figure 13:
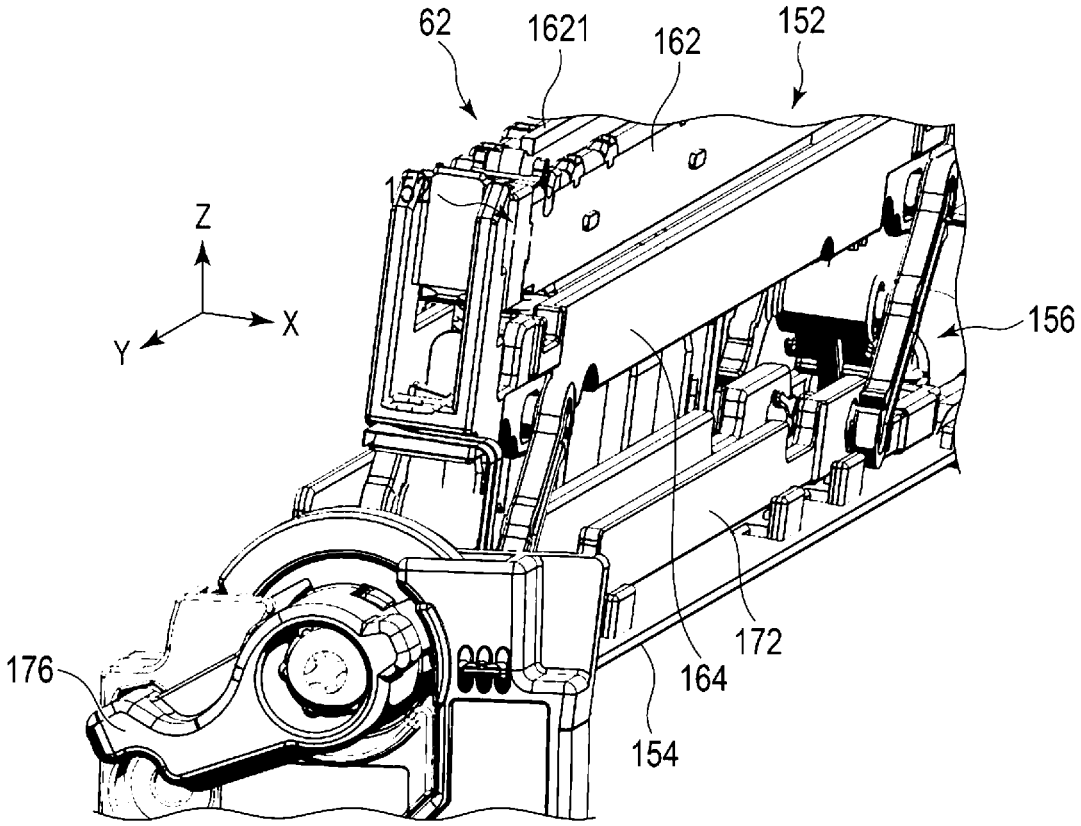
FIG. 13 is a schematic perspective view illustrating a portion of the solid-state head unit.

FIG. 9 is a schematic perspective view illustrating the solid-state head unit. FIG. 10 is a schematic cross-sectional view illustrating a state where the exposure device 152 of the solid-state head unit 62 is allowed to be separated from a photoconductor drum 122 of the photoconductor unit 102. FIG. 11 is a schematic cross-sectional view illustrating a state where the exposure device 152 of the solid-state head unit 62 is allowed to be close to the photoconductor drum 122 of the photoconductor unit 102. FIG. 12 is a schematic perspective view illustrating a state where the exposure device 152 of the solid-state head unit 62 is disposed in a descended position where the exposure device 152 is descended. FIG. 13 is a schematic perspective view illustrating a state where the exposure device 152 of the solid-state head unit 62 is disposed in an ascended position where the exposure device 152 is ascended.

As illustrated in FIG. 1, the image forming apparatus 10 according to at least one embodiment includes an apparatus main body 12, a control unit 14 (e.g., a controller), a sheet supply unit 16 (e.g., a sheet supplier), a control panel 18, a scanner unit 20 (e.g., a scanner), a conveying unit 22 (e.g., a conveying device, a conveyer), a printer 24, and a paper ejection unit 26 (e.g., a paper ejector).

The apparatus main body 12 forms a front surface, a back surface, a right side surface, and a left side surface of the image forming apparatus 10. The sheet supply unit 16 is provided on a lower side of the apparatus main body 12. The control panel 18, the scanner unit 20, and the paper ejection unit 26 are provided on an upper side of the apparatus main body 12. The control unit 14, the conveying unit 22, and the printer 24 are provided in the apparatus main body 12.

The control unit 14 controls the sheet supply unit 16, the control panel 18, the scanner unit 20, the conveying unit 22, and the printer 24.

The sheet supply unit 16 has, for example, a plurality of paper feed cassettes 32 that accommodate a large number of sheets 34. The sheet supply unit 16 picks up the sheets 34, one-by-one, necessary for image formation from each paper feed cassette 32. The sheet supply unit 16 supplies the picked-up sheet 34 to the conveying unit 22.

The control panel 18 is formed as, for example, a touch panel that receives user's operations. The control panel 18 outputs signals corresponding to the user's operations to the control unit 14.

The scanner unit 20 reads image information of a read target and outputs the image information to the control unit 14.

The conveying unit 22 conveys the sheet 34 supplied from the paper feed cassette 32 of the sheet supply unit 16 to the paper ejection unit 26 through the printer 24.

The printer 24 transfers and fixes the image read by, for example, the scanner unit 20 to the sheet 34 that is conveyed by the conveying unit 22. The conveying unit 22 ejects the sheet 34 on which the image is fixed by the printer 24 to the paper ejection unit 26.

The printer 24 includes the image forming units 42, 44, 46, and 48, the toner cartridges 52, 54, 56, and 58, the solid-state head units 62, 64, 66, and 68, the transfer unit 72, and a fixing unit 74 (e.g., a fixing device).

The image forming units 42, 44, 46, and 48, the toner cartridges 52, 54, 56, and 58, the solid-state head units 62, 64, 66, and 68, the transfer unit 72, and the fixing unit 74 are located in the apparatus main body 12. The apparatus main body 12 regulates the movement in the ±X-axis direction and the ±Z-axis direction in a state where the image forming units 42, 44, 46, and 48, the toner cartridges 52, 54, 56, and 58, the solid-state head units 62, 64, 66, and 68, the transfer unit 72, and the fixing unit 74 are located in the apparatus main body 12.

As illustrated in FIGS. 1 and 2, the transfer unit 72 includes a transfer belt 202, a transfer belt roller 204, a secondary transfer facing roller 206, a support roller 208, a belt suspension roller 210, four primary transfer rollers 212, and a secondary transfer roller 214.

The transfer belt 202 is an endless belt. The transfer belt 202 is an intermediate transfer body that forms a toner image by the image forming units 42, 44, 46, and 48.

The transfer belt roller 204, the secondary transfer facing roller 206, the support roller 208, and the belt suspension roller 210 apply tension to the transfer belt 202 to support the transfer belt 202. The transfer belt roller 204, the secondary transfer facing roller 206, the support roller 208, and the belt suspension roller 210 rotate in an axial rotation of a central axis parallel to the Y-axis. The transfer belt roller 204 rotates the transfer belt 202 in a direction of an arrow A by rotation. The secondary transfer facing roller 206, the support roller 208, and the belt suspension roller 210 rotate in a driven manner according to the rotation of the transfer belt 202.

The image forming units 42, 44, 46, and 48 are in this order along the direction of the arrow A in which the transfer belt 202 rotates.

The primary transfer rollers 212 face the photoconductor drums 122 of the image forming units 42, 44, 46, and 48, respectively, via the transfer belt 202. A transfer bias is applied to the primary transfer roller 212 in synchronization with the photoconductor drum 122. The primary transfer rollers 212 primary transfer the toner images formed on the photoconductor drums 122 of the image forming units 42, 44, 46, and 48 to the transfer belt 202, respectively. The formation of the toner images by the image forming units 42, 44, 46, and 48 and the movement of the transfer belt 202 are synchronized. The image forming units 42, 44, 46, and 48 sequentially transfer the toner images to the transfer belt 202 and superimpose the toner images. The image forming units 42, 44, 46, and 48 illustrated in FIG. 2 form images of yellow (Y), magenta (M), cyan (C), and black (K), respectively, and transfer the images to the transfer belt 202 of the transfer unit 72. For this reason, a full-color image is formed on the transfer belt 202.

The secondary transfer roller 214 illustrated in FIG. 1 cooperates with the secondary transfer facing roller 206 to constitute a secondary transfer unit (e.g., a secondary transfer device) that transfers the toner image, which is primarily transferred to the transfer belt 202, to the sheet 34. The secondary transfer roller 214 faces the secondary transfer facing roller 206 via the transfer belt 202. The outer peripheral surface of the secondary transfer roller 214 comes into contact with the transfer belt 202. The secondary transfer roller 214 rotates in a driven manner according to circulation of the transfer belt 202. The secondary transfer roller 214 transfers the toner image on the transfer belt 202 to the sheet 34.

The transfer unit 72 includes a cleaner 216. The cleaner 216 removes the toner adhering to the transfer belt 202.

The image forming units 42, 44, 46, and 48 have substantially the same structure except for the difference in toner color. Therefore, in at least one embodiment, the image forming unit 42 will be described, and the description of the image forming units 44, 46, and 48 will be omitted. Similarly, the toner cartridges 52, 54, 56, and 58 have substantially the same structure. Therefore, in at least one embodiment, the toner cartridge 52 will be described, and the description of the toner cartridges 54, 56, and 58 will be omitted. Similarly, the solid-state head units 62, 64, 66, and 68 have substantially the same structure. Therefore, in at least one embodiment, the solid-state head unit 62 will be described, and the description of the solid-state head units 64, 66, and 68 will be omitted.

As illustrated in FIG. 3, the image forming unit 42 includes a photoconductor unit 102 (e.g., a photoconductor), a charging unit 104 (e.g., a charger), a developing device 106, a cleaner blade 108, and an electricity elimination device 110. The image forming unit 42 is replaceably attached to the apparatus main body 12 of the image forming apparatus 10. The image forming unit 42 is attached to and detached from the image forming apparatus 10 by being inserted into and removed from the front side of the image forming apparatus 10 along the Y-axis.

The charging unit 104, the solid-state head unit 62, the developing device 106, the cleaner blade 108, and the electricity elimination device 110 are disposed around the Y-axis of the photoconductor unit 102.

As illustrated in FIGS. 3 to 6, the photoconductor unit 102 includes the photoconductor 120 having the photoconductor drum 122 and the shaft portions 124 formed at both ends of the photoconductor drum 122, a pair of the bearings 126 rotatably receiving a pair of the shaft portions 124, and a support frame (cleaner case) 128 supporting the pair of bearings 126.

The photoconductor drum 122 is formed to have a cylindrical shape. The photoconductor drum 122 rotates, for example, in an axial rotation of a central axis parallel to the Y-axis.

The pair of shaft portions 124 defines the rotation axis (central axis) of the photoconductor drum 122. The pair of shaft portions 124 are formed to have a cylindrical shape or a columnar shape. The pair of shaft portions 124 is made of, for example, a polyacetal (POM) resin.

Each pair of bearings 126 has a bearing body (e.g., a bush) 132 and an abutting portion (e.g., a protrusion) 134 provided on the bearing body 132. The bearing body 132 and the abutting portion 134 are supported by the support frame 128.

The bearing body 132 is formed to have a cylindrical shape with, for example, a resin material such as a polyacetal (POM) resin or a polybutylene terephthalate (PBT) resin. The bearing body 132 rotatably supports the pair of shaft portions 124 of the photoconductor 120.

The abutting portion 134 is preferably formed integrally with the bearing body 132. The abutting portion 134 extends from an outer peripheral surface of the bearing body 132. An extending direction of the abutting portion 134 is, for example, a direction along the outer peripheral surface of the bearing body 132 in the radial direction. In at least one embodiment, the abutting portion 134 extends from the outer peripheral surface of the bearing body 132 in the direction toward the solid-state head unit 62.

As illustrated in FIGS. 4 and 5, the abutting portion 134 of one bearing 126 of the pair of bearings 126 includes a plurality of extension members 1341 extending from the bearing body 132 toward the exposure device 152 of the solid-state head unit 62. In at least one embodiment, one abutting portion 134 has the two extension members 1341. As illustrated in FIGS. 4 and 6, the abutting portion 134 of the other bearing 126 of the pair of bearings 126 has one extension member 1342 extending from the bearing body 132 toward the exposure device 152 of the solid-state head unit 62.

As illustrated in FIG. 7, each end portion (e.g., extended end portion) 1343 of the two extension members 1341 of one abutting portion 134 with respect to the bearing body 132 is formed to have a shape being convex toward the exposure device 152 of the solid-state head unit 62. The two end portions 1343 of one abutting portion 134 are formed, for example, as a portion of the outer peripheral surface of a cylinder.

As illustrated in FIG. 8, the end portion (e.g., the extended end portion) 1344 of the extension member 1342 of the other abutting portion 134 with respect to the bearing body 132 is formed to have a shape being convex to the exposure device 152 of the solid-state head unit 62. The end portion 1344 of the other abutting portion 134 is formed, for example, as a portion of the outer peripheral surface of a cylinder.

The two end portions 1343 of the two extension members 1341 of the one abutting portion 134 are supported by the exposure device 152, and the end portion 1344 of one extension member 1342 of the other abutting portion 134 is supported by the exposure device 152. Therefore, the pair of abutting portions 134 according to at least one embodiment are supported by the exposure device 152 at at least three points.

As illustrated in FIG. 4, the support frame 128 rotatably supports the photoconductor 120 via the bearing 126. The support frame 128 is formed of, for example, an acrylonitrile butadiene styrene (ABS) resin containing glass fiber.

The support frame 128 has an annular wall portion 1281 that forms a through-hole through which the abutting portion 134 moves. The moving direction of the abutting portion 134 is a direction along the axial direction of the through-hole formed by the wall portion 1281. In FIG. 4, the moving directions of the solid-state head unit 62 and the bearing 126 are drawn as a direction along the Z-axis, but the moving directions may be deviated from the Z-axis such as being inclined with respect to the Z-axis.

The support frame 128 has a protrusion (e.g., a dowel) 1282 that is inserted into the wall portion (e.g., a dowel hole) 16221 of the exposure device 152. The protrusion 1282 has a size that is fit into the wall portion 16221.

The charging unit 104 illustrated in FIG. 3 uniformly charges the outer peripheral surface of the photoconductor drum 122 to a predetermined potential.

The developing device 106 attaches a developer such as toner to the outer peripheral surface of the photoconductor drum 122 to develop an electrostatic latent image on the outer peripheral surface of the photoconductor drum 122. The developing device 106 includes a container 1061 that contains the toner supplied from the toner cartridge 52, a mixer 1062 that is provided in the container 1061 to stir the developer, a magnet roller (developing roller) 1063 that carries the developer on the outer peripheral surface, and a doctor blade 1064 that equalizes the thickness of the developer carried on the outside of the magnet roller 1063. The central axis of the magnet roller 1063 is parallel to the central axis of the photoconductor drum 122 and the central axis of the shaft portion 124. The length of the magnet roller 1063 along the longitudinal direction is formed to be, for example, the same as or shorter than the length of the photoconductor drum 122 along the longitudinal direction. Since the toner is charged, if the magnet roller 1063 rotates, the toner is attracted to the electrostatic latent image of the photoconductor drum 122, so that the electrostatic latent image is developed.

The container 1061 of the developing device 106 has a pressurizing unit 10611 (e.g., a pressurizing device, pressurizer or pressure applicator) that pressurizes the bearing body 132 through the support frame 128 of the photoconductor unit 102 and positions the positional relationship between the outer peripheral surface of the photoconductor drum 122 and the magnet roller 1063 of the developing device 106. The pressurizing unit 10611 pressurizes the bearing body 132 toward, for example, the central axis of the bearing body 132. That is, the pressurizing unit 10611 pressurizes the bearing 126 from a direction different from the direction from the exposure device 152 toward the bearing 126.

The cleaner blade 108 is disposed at a position on the photoconductor drum 122 in the +X-axis direction. For this reason, the cleaner blade 108 is disposed at a position where the photoconductor drum 122 is interposed between the cleaner blade 108 and the developing device (developer) 106. Then, the cleaner blade 108 is in contact with the outer peripheral surface of the photoconductor drum 122 and is in contact with the outer peripheral surface of the photoconductor drum 122 from the side opposite to a pressurizing direction of the pressurizing unit 10611 of the developing device 106. The cleaner blade 108 cleans the untransferred, remaining toner of the photoconductor drum 122. Accordingly, the photoconductor drum 122 is in a standby state for the next image formation. The cleaner blade 108 is formed, for example, to be the same as or shorter than the length of the photoconductor drum 122 along the longitudinal direction.

The electricity elimination device 110 eliminates non-uniform surface charges of the photoconductor drum 122, for example, by irradiating the photoconductor drum 122 with light.

As illustrated in FIGS. 9 to 13, the solid-state head unit 62 includes an exposure device 152, a base 154, a moving mechanism (e.g., a mover, an elevating mechanism) 156, and an urging body 158.

The exposure device 152 includes a print head 162 that exposes the photoconductor drum 122 to form a latent image on the photoconductor drum 122, and a holder 164 that holds the print head 162.

The print head 162 extends so that the longitudinal direction is along the Y-axis direction of the image forming apparatus 10 and is disposed inside the apparatus main body 12 of the image forming apparatus 10. The print head 162 includes a light source 1621 and a pair of fixing portions 1622 that are fixed to both end portions of the light source 1621.

A light emitting element of the light source 1621 is configured with, for example, an LED or an organic EL (OLED). As the light emitting elements, for example, LED elements are disposed along the Y-axis direction. The light source 1621 of the print head 162 faces the photoconductor drum 122.

As illustrated in FIG. 4, each of the pair of fixing portions 1622 has a wall portion 16221 that is formed as, for example, a concave hole or a dowel hole of a through-hole and an abutted portion 16222 that abuts on the abutting portion 134 of the bearing 126 of the photoconductor unit 102.

The pair of wall portions 16221 are separated in the Y-axis direction. The pair of wall portions 16221 are formed at positions facing the support frame 128 of the photoconductor unit 102.

The pair of abutted portions 16222 are separated from each other in the Y-axis direction. The pair of wall portions 16221 are disposed between the pair of abutted portions 16222. The pair of abutted portions 16222 are located at both end portions of the exposure device 152 in the longitudinal direction. If the print head 162 becomes close to the photoconductor drum 122, each of the pair of abutted portions 16222 abuts on the end portion 1343 of the extension member 1341 illustrated in FIG. 7 and the end portion 1344 of the extension member 1342 illustrated in FIG. 8 of the abutting portion 134 of the bearing 126 of the photoconductor unit 102.

The pair of urging bodies 158 are disposed between the print head 162 and the holder 164. The pair of urging bodies 158 are separated in the Y-axis direction as in, for example, the wall portion 16221 or the pair of abutted portions 16222 and urge the print head 162 with respect to the holder 164 toward the photoconductor drum 122. The pair of urging bodies 158 are configured with, for example, compression coil springs. The pair of urging bodies 158 may be made of, for example, a columnar rubber material that is elastically deformed.

As illustrated in FIGS. 9 to 13, the base 154 has a plate shape of which longitudinal direction is along the Y-axis direction. The base 154 supports a portion of the moving mechanism 156.

The moving mechanism 156 is provided between the base 154 and the exposure device 152. The moving mechanism 156 reciprocates the exposure device 152 with respect to the base 154 in the uniaxial direction. The uniaxial direction is a direction in which the exposure device 152 is allowed to be close to and separated from the support frame 128 of the photoconductor unit 102. In FIGS. 4 and 9 to 13, the uniaxial direction is drawn as a direction along the ±Z-axis, but the uniaxial direction may be inclined with respect to the ±Z-axis.

The moving mechanism 156 includes a slider 172 that can move in the longitudinal direction of the base 154, a spring 174 that urges the slider 172, a lever 176 for moving the slider 172, and a link mechanism 178.

The slider 172 is movably supported by the base 154 in the longitudinal direction along the Y-axis.

One end of the spring 174 is fixed to the base 154 and the other end is fixed to the slider 172. The spring 174 urges the slider 172 toward the lever 176 along the Y-axis direction.

The lever 176 is rotatable in an axial rotation of the Y-axis. The lever 176 is operated to rotate in a first direction from a first position to a second position, so that the lever 176 moves the slider 172 against the urging force of the spring 174. If the lever 176 rotates in the first direction, the slider 172 moves toward the spring 174 against the urging force of the spring 174. On the contrary, the lever 176 is operated to rotate in a second direction opposite to the first direction from the second position to the first position, so that the slider 172 moves toward the lever 176 by the urging force of the spring 174.

The link mechanism 178 converts the longitudinal movement of the slider 172 into the movement of the holder 164 in a direction intersecting the longitudinal direction. As the link mechanism 178, for example, a Scott Russell type link mechanism is used to achieve linear motion. The Scott Russell-type link mechanism 178 converts the longitudinal movement of the slider 172 into the movement of the holder 164 in the longitudinal direction.

Next, the operations of the image forming unit 42 and the solid-state head unit 62 of the image forming apparatus 10 will be described.

The moving mechanism 156 illustrated in FIGS. 9 to 11 rotates in the first direction from the first position (e.g., see FIG. 12) to the second position (e.g., see FIG. 13) in an axial rotation of the Y-axis of the lever 176, so that the slider 172 is allowed to be moved in a direction of the spring 174. As the slider 172 moves, the exposure device 152 moves toward the support frame 128 of the photoconductor unit 102 by the operation of the link mechanism 178. Therefore, as illustrated in FIGS. 9 and 11, the moving mechanism 156 allows the exposure device 152 to be close (e.g., ascended) toward the support frame 128 of the photoconductor unit 102. The moving mechanism 156 rotates in the second direction opposite to the first direction from the second position (e.g., see FIG. 13) to the first position (e.g., see FIG. 12) in an axial rotation of the Y-axis of the lever 176, so that the slider 172 is allowed to be moved in a direction separated from the spring 174. As the slider 172 moves, the exposure device 152 is separated from the support frame 128 of the photoconductor unit 102 by the operation of the link mechanism 178. Therefore, the moving mechanism 156 separates (e.g., descends) the exposure device 152 from the support frame 128 of the photoconductor unit 102. The direction in which the exposure device 152 becomes close to and becomes separated from the support frame 128 of the photoconductor unit 102 is a direction intersecting the moving direction of the slider 172 and is preferably, for example, the vertical direction.

Herein, as illustrated in FIGS. 12 and 13, if the photoconductor unit 102 is not disposed in the apparatus main body 12, a maximum moving stroke of the exposure device 152 by the moving mechanism 156 is larger than an interval (e.g., gap) defined between the exposure device 152 and the outer peripheral surface of the photoconductor drum 122. The maximum moving stroke of the moving mechanism 156 denotes the maximum distance that the exposure device 152 can move by the moving mechanism 156 in a state where the photoconductor unit 102 does not exist.

The moving mechanism 156 moves the exposure device 152 from the state at the separated position illustrated in FIG. 10 to the state at the close position illustrated in FIG. 11 with respect to the photoconductor unit 102. If the photoconductor unit 102 is disposed in the apparatus main body 12, a moving distance of the exposure device 152 is smaller than the maximum moving stroke of the exposure device 152. For this reason, if the exposure device 152 is moved to the close state illustrated in FIG. 11 with respect to the photoconductor unit 102, the exposure device 152 exerts the urging force on the photoconductor unit 102.

As illustrated in FIGS. 4 and 9 to 11, in a state where the photoconductor unit 102 is disposed in the apparatus main body 12, the lever 176 is rotated from the first position to the second position in the first direction to allow the exposure device 152 to be close to the support frame 128. As illustrated in FIG. 4, a pair of the protrusions 1282 of the support frame 128 are inserted into a pair of the wall portions (e.g., dowel holes) 16221 separated in the Y-axis direction of the exposure device 152. For this reason, the exposure device 152 is guided toward the support frame 128.

As illustrated in FIG. 10, it is assumed that the outer peripheral surface of the photoconductor drum 122 is not disposed parallel to the print head 162 in a state where the exposure device 152 and the photoconductor unit 102 are separated from each other. As illustrated in FIG. 11, if the exposure device 152 becomes close to the support frame 128 by the moving mechanism 156, for example, first, one abutted portion 16222 of the pair of fixing portions 1622 illustrated in FIG. 4 abuts on one abutting portion 134 of the bearings 126. After that, the exposure device 152 continues to become close to the support frame 128 by the moving mechanism 156 and the pair of urging bodies 158. For this reason, the other abutted portion 16222 abuts on the other abutting portion 134 of the bearing 126.

Herein, the image forming unit 42 disposed in the apparatus main body 12 is regulated in moving in the vertical direction and the horizontal direction. For this reason, if the exposure device 152 is in a position close to the support frame 128, the abutting portion 134 of the bearing 126 is exerted by an urging force from the pair of urging bodies 158 of the solid-state head unit 62 via the exposure device 152. The pair of abutting portions 134 urge the pair of bearing bodies 132 upward by the pair of urging bodies 158. For this reason, the rotation axis (e.g., central axis) of the photoconductor 120 is disposed in a desired state. As a result, the light source 1621 of the print head 162 of the exposure device 152 is disposed parallel to the outer peripheral surface of the photoconductor drum 122. For this reason, in a state where the photoconductor unit 102 is disposed in the apparatus main body 12, a predetermined interval is formed between the light source 1621 of the print head 162 of the exposure device 152 and the outer peripheral surface of the photoconductor drum 122.

If the print head 162 is closest to the photoconductor drum 122, the pair of urging bodies 158 disposed between the print head 162 and the holder 164 exert a predetermined abutting load on the photoconductor drum 122 to the print head 162. That is, the pair of urging bodies 158 urges the pair of abutting portions 134 of the bearing 126 toward the central axis of the bearing body 132 with the pair of abutted portions 16222 via the print head 162. As described above, the urging direction of the pair of abutting portions 134 by the pair of urging bodies 158 is the direction intersecting the rotation axis of the shaft portion 124 of the photoconductor 120.

As illustrated in FIG. 7, each of the end portions 1343 of the pair of extension members 1341 of the one abutting portion 134 is formed to be convex to the print head 162 of the exposure device 152. As illustrated in FIG. 8, the end portion 1344 of the extension member 1342 of the other abutting portion 134 is formed to be convex to the print head 162 of the exposure device 152. For this reason, the abutting portion 134 according to at least one embodiment is supported by the print head 162 of the exposure device 152 at a total of three points of two points on one side and one point on the other side. Therefore, since the abutting portion 134 is supported at three points between the photoconductor unit 102 and the exposure device 152, the abutting portion 134 is supported in a more stable state than the case where the abutting portion 134 is supported at two points.

A portion of the abutting load of the exposure device 152 with respect to the abutting portion 134 of the photoconductor unit 102 is determined by the pair of urging bodies 158 disposed between the print head 162 and the holder 164. If the exposure device 152 becomes close to the support frame 128 by the moving mechanism 156, the print head 162 of the exposure device 152 is disposed parallel to the outer peripheral surface of the photoconductor drum 122. For this reason, the abutting loads of the exposure device 152 to the shaft portions 124 at both end portions of the photoconductor 120 in the longitudinal direction are substantially equal. That is, a substantial variation of the load applied by the exposure device 152 to the shaft portion 124 of the photoconductor unit 102 is unlikely to occur at both end portions in the Y-axis direction (longitudinal direction). Furthermore, as the abutting load of the exposure device 152 to the bearing 126 of the photoconductor unit 102, a predetermined abutting load can be obtained.

The inclination of the print head 162 with respect to the photoconductor drum 122 is a factor that deteriorates the quality of the image formed by the image forming apparatus 10. In the exposure device 152 of at least one embodiment, since the print head 162 is disposed parallel to the photoconductor drum 122, deterioration of the quality of the image formed on the photoconductor drum 122 can be prevented.

In the exposure device 152 and the photoconductor unit 102 of at least one embodiment, a variation of the abutting load of the exposure device 152 to the photoconductor unit 102 is unlikely to occur. For this reason, the exposure device 152 can prevent the occurrence of variation in the focal position of the exposure device 152 with respect to the photoconductor drum 122.

The pair of abutting portions 134 urges the pair of bearing bodies 132 upward by the urging body 158. For this reason, the support frame 128 receives a force from each of the pair of bearing bodies 132. At this time, the pair of shaft portions 124 of the photoconductor unit 102 and the inner peripheral surfaces of the pair of bearing bodies 132 can slide on each other. However, there are no parts that slide on the outer peripheral surface of the photoconductor drum 122. In the image forming apparatus 10 according to at least one embodiment, the outer peripheral surface of the photoconductor drum 122 is in direct contact between the outer peripheral surface of the photoconductor drum 122 and the exposure device 152, and thus, a spacer defining a gap between the outer peripheral surface of the photoconductor drum 122 and the exposure device 152 becomes unnecessary. For this reason, the image forming apparatus 10 according to at least one embodiment does not need to consider a decrease in positioning accuracy due to wear of the spacer.

In FIG. 4, the urging body 158 and the abutting portion 134 are disposed on the same axis along the moving direction of the exposure device 152. For this reason, the urging force of the urging body 158 can be directly transmitted to the bearing 126 via the print head 162. For this reason, it is possible to prevent a moment from being generated by the urging force of the urging body 158.

It is noted that the pressurizing unit 10611 of the container 1061 of the developing device 106 pressurizes the bearing body 132 toward the central axis of the bearing body 132. For this reason, the bearing body 132 of the bearing 126 is urged toward the side opposite to the developing device 106 with respect to the support frame 128. Since the bearing body 132 of the bearing 126 is urged toward the side opposite to the developing device 106, the photoconductor drum 122 is urged toward the side opposite to the developing device 106. Therefore, the state is maintained in which the cleaner blade 108 is in contact with the outer peripheral surface of the photoconductor drum 122.

At this time, the bearing body 132 is substantially urged with respect to the support frame 128 toward the upper right direction in FIG. 5 and the upper left direction in FIG. 6, which are indicated by reference numerals F.

If the exposure device 152 abuts on the abutting portion 134, the exposure device 152 is guided to the support frame by the protrusion 1282 provided on the support frame 128 and the wall portion 16221 of the exposure device 152. Then, the urging force of the urging body 158 is transmitted to the support frame 128 via the print head 162 and the bearing 126. Since the bearing body 132 of the bearing 126 supports the shaft portion 124 of the photoconductor drum 122, the outer peripheral surface of the photoconductor drum 122 and the print head 162 are disposed with a predetermined gap. The interval between the outer peripheral surface of the photoconductor drum 122 and the print head 162 needs to be highly accurate, but the photoconductor drum 122 according to at least one embodiment does not cause friction with other parts. Therefore, according to the image forming apparatus 10 according to at least one embodiment, the interval between the outer peripheral surface of the photoconductor drum 122 and the print head 162 is maintained with a predetermined high accuracy.

If a spacer is disposed between the print head 162 and the photoconductor drum 122 and the interval between the outer peripheral surface of the photoconductor drum 122 and the print head 162 intends to be maintained by the spacer, there is a possibility that the spacer may be worn out. In this case, there is a possibility that the interval between the photoconductor drum 122 and the print head 162 may become unstable. According to the image forming apparatus 10 according to at least one embodiment, there is no part that is in direct contact with the photoconductor drum 122, and the interval between the photoconductor drum 122 and the print head 162 can be maintained.

It is noted that the protrusion 1282 of the support frame 128 described in at least one embodiment may be configured to be a wall portion forming a concave hole or a through-hole, and the wall portion (dowel hole) 16221 of the fixing portion 1622 of the print head 162 may be configured to be a protrusion.

In at least one embodiment, the image forming unit 42 and the solid-state head unit 62 are described. The image forming units 44, 46, and 48 have the same structure as the image forming unit 42, and the solid-state head units 64, 66, and 68 have the same structure as the solid-state head unit 62. For this reason, the relationship between the image forming unit 44 and the solid-state head unit 64, the relationship between the image forming unit 46 and the solid-state head unit 66, and the relationship between the image forming unit 48 and the solid-state head unit 68 are also configured as the same relationship between the image forming unit 42 and the solid-state head unit 62.

Therefore, according to at least one embodiment, it is possible to provide an image forming apparatus 10 that maintains dimensional accuracy between the exposure device 152 and the outer peripheral surface of the photoconductor drum 122 in a state where any part in contact with the outer peripheral surface of the photoconductor drum 122 is eliminated.

Figure 14:
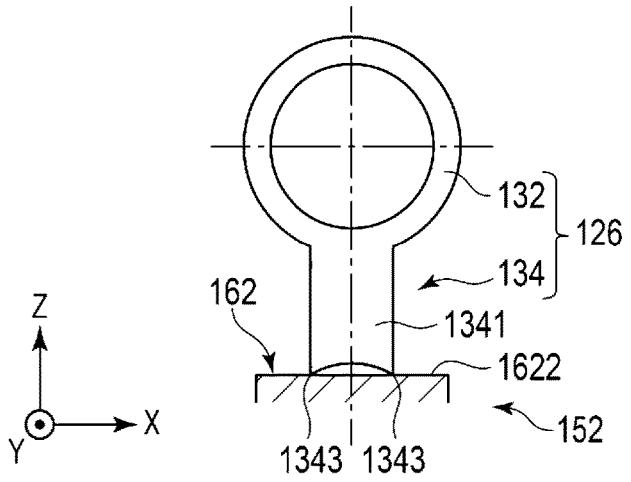
FIG. 14 is a schematic view illustrating a portion of a bearing of the photoconductor unit and a portion of a print head of the solid-state head unit of the image forming apparatus according to a modified example of the first embodiment.

It is noted that, as illustrated in FIG. 14, the number of end portions 1343 of the extension member 1341 of the one of the abutting portions 134 may be one instead of two. In this case, it is also preferable that the end portion 1343 of the extension member 1341 of the one abutting portion 134 is formed to be concave to the exposure device 152. For this reason, the end portion 1343 of the extension member 1341 of the one abutting portion 134 is formed as a protrusion that is in contact with the exposure device 152 at two points. For this reason, for example, the one abutting portion 134 is supported at two points illustrated in FIG. 14 with respect to the exposure device 152, and the other abutting portion 134 is supported at one point illustrated with reference to FIG. 8 with respect to the exposure device 152, so that the abutting portions are supported at a total of three points. Therefore, the photoconductor unit 102 and the exposure device 152 are supported in a more stable state than that case where the photoconductor unit 102 and the exposure device 152 are supported at two points. That is, the one abutting portion 134 may be formed with one extension member 1341 illustrated in FIG. 14 or may be formed with a plurality of extension members 1341 illustrated in FIG. 7.

The other abutting portion 134 may be formed with one extension member 1342 illustrated in FIG. 8, may be formed with a plurality of extension members 1341 illustrated in FIG. 7, or may be formed with one extension member 1341 illustrated in FIG. 14. For this reason, the pair of abutting portions 134 have a protrusion that is in contact with the exposure device 152 at two points on the one side and at one or two points, that is, at least one point on the other side when viewed from the direction along the longitudinal direction of the photoconductor 120 at the end portion (e.g., the extending end portion) 1343 with respect to the bearing body 132. For this reason, the pair of abutting portions 134 may be supported by the exposure device 152 at three points or at four points.

Second Embodiment

Figure 15:
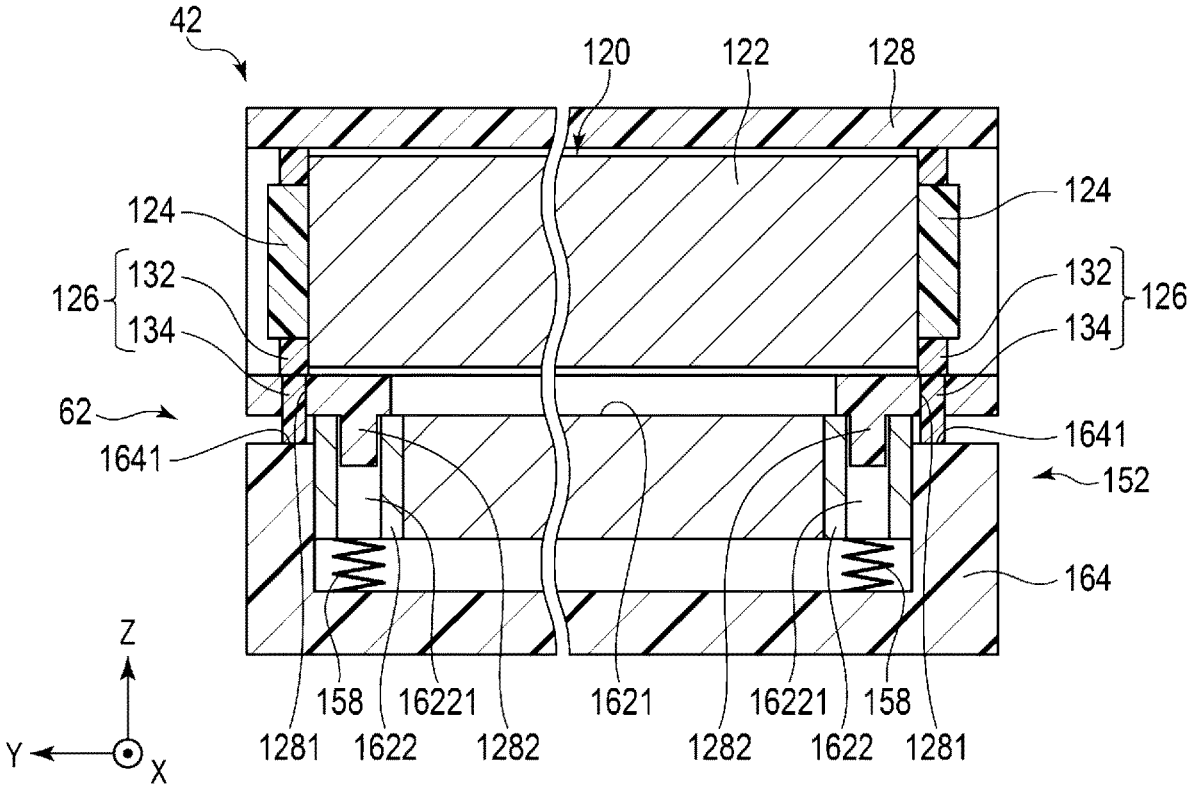
FIG. 15 is a view of the image forming unit and the solid-state head unit of the printer viewed from a front side of the image forming apparatus.

A second embodiment will be described with reference to FIG. 15. FIG. 15 illustrates a modified example of the exposure device 152 of the solid-state head unit 62 of the image forming apparatus 10 described in the first embodiment.

As illustrated in FIG. 15, in at least one embodiment, the abutting portion 134 is supported not by the print head 162 but by the abutting portion 1641 of the holder 164. That is, the abutting portion 134 can be supported by the exposure device 152. In this case, the print head 162 can become closer to the support frame 128 with respect to the position of the holder 164 and the abutting portion 134 of the bearing 126. In this manner, a distance between the support frame 128 and the print head 162 may be secured.

Therefore, according to at least one the embodiment, it is possible to provide an image forming apparatus (e.g., image forming apparatus 10) that maintains a high dimensional accuracy between the exposure device (e.g., exposure device 152) and the outer peripheral surface of the photoconductor (e.g., photoconductor drum 122) in a state where any part in contact with the outer peripheral surface of the photoconductor (e.g., the photoconductor drum 122) is eliminated.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a photoconductor comprising a shaft portion at an end portion of the photoconductor;

a bearing body configured to receive the shaft portion;

an abutting portion coupled to the bearing body;

a support frame configured to support the abutting portion and the bearing body;

an exposure device facing the photoconductor and abutting the abutting portion, the exposure device comprising a light source exposing the photoconductor to light;

an urging body configured to press the exposure device toward the support frame, urge the abutting portion toward the bearing body and the shaft portion, and urge the bearing body toward the support frame; and a developing device comprising a pressurizer configured to pressurize the shaft portion from a direction different from the direction from the exposure device toward the shaft portion.

2. The apparatus of claim 1, wherein the abutting portion extends from the bearing body toward the exposure device and moves uniaxially with respect to the support frame, the exposure device, and the urging body.

3. The apparatus of claim 1, wherein the abutting portion is formed integrally with the bearing body, and the shaft portion rotates with respect to the bearing body.

4. The apparatus of claim 1, wherein the abutting portion comprises a protrusion in contact with the exposure device at two or more points.

5. The apparatus of claim 4, wherein the abutting portion comprises a protrusion in contact with the exposure device at two points when viewed in a direction along a longitudinal direction of the photoconductor.

6. The apparatus of claim 1, wherein the urging body and the abutting portion are on the same axis.

7. The apparatus of claim 1, wherein an urging direction of the abutting portion caused by the urging body is a direction intersecting a rotation axis of the shaft portion.

8. The apparatus of claim 1, wherein the abutting portion comprises one extension member extending from the bearing body toward the exposure device.

9. The apparatus of claim 1, wherein the abutting portion comprises a plurality of extension members extending from the bearing body toward the exposure device.

10. The apparatus of claim 1, further comprising a cleaner blade in contact with the outer peripheral surface of the photoconductor and the outer peripheral surface of the photoconductor from a side opposite to a pressurizing direction of the pressurizer.

11. The apparatus of claim 1, wherein the exposure device further comprises a print head configured to expose a photoconductor drum to form a latent image on the photoconductor drum and a holder configured to hold the print head.

12. The apparatus of claim 11, wherein the print head is disposed inside an apparatus main body of the image forming apparatus.

13. The apparatus of claim 11, wherein the print head includes a light source.

14. The apparatus of claim 11, wherein the abutting portion is supported by the print head of the exposure device.

15. The apparatus of claim 11, wherein the abutting portion is supported by an abutting portion of the holder.

* * * * *